US008070504B2

(12) United States Patent
Amidon et al.

(10) Patent No.: US 8,070,504 B2
(45) Date of Patent: Dec. 6, 2011

(54) COAXIAL CABLE PORT LOCKING TERMINATOR AND METHOD OF USE THEREOF

(75) Inventors: Jeremy Amidon, Marcellus, NY (US); Eric Purdy, Constantia, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/486,009

(22) Filed: Jun. 17, 2009

(65) Prior Publication Data

US 2010/0323541 A1 Dec. 23, 2010

(51) Int. Cl.
*H01R 13/62* (2006.01)

(52) U.S. Cl. ..... 439/321; 439/307; 439/578

(58) Field of Classification Search ..... 439/578, 439/321, 307

See application file for complete search history.

(56) References Cited

U.S. PATENT DOCUMENTS

| | | | | |
|---|---|---|---|---|
| 4,940,260 | A * | 7/1990 | Uriarte Odriozola | 285/3 |
| 5,199,894 | A | 4/1993 | Kalny et al. | |
| 6,123,563 | A * | 9/2000 | Johnson et al. | 439/321 |
| 6,152,753 | A * | 11/2000 | Johnson et al. | 439/321 |
| 6,491,546 | B1 | 12/2002 | Perry | |
| 6,557,900 | B1 * | 5/2003 | Austin | 439/321 |
| 6,971,912 | B2 | 12/2005 | Montena | |
| 7,086,876 | B1 | 8/2006 | Montena | |
| 7,163,420 | B2 | 1/2007 | Montena | |
| 7,452,239 | B2 | 11/2008 | Montena | |
| 7,600,789 | B2 * | 10/2009 | Vyse et al. | 285/91 |
| 2006/0003629 | A1 | 1/2006 | Murphy et al. | |
| 2006/0089027 | A1 | 4/2006 | Chawgo et al. | |
| 2006/0240709 | A1 | 10/2006 | Montena et al. | |

FOREIGN PATENT DOCUMENTS

| | | | |
|---|---|---|---|
| KR | 20-0230714 | Y1 | 7/2001 |
| KR | 10-0557494 | B1 | 12/2004 |

OTHER PUBLICATIONS

Application No. PCT/US2010/038455, International Search Report and the Written Opinion of the International Searching Authority, or the Declaration dated Jan. 12, 2011. 7 pages.

* cited by examiner

*Primary Examiner* — Truc T Nguyen
(74) *Attorney, Agent, or Firm* — Schmeiser, Olsen & Watts, LLP

(57) ABSTRACT

Disclosed herein is a coaxial cable interface port locking terminator including an outer terminator housing and an inner connector body housed within the outer terminator housing. The coaxial cable interface port locking terminator further includes a ratcheting device in operable communication with the outer terminator housing and the inner connector body, the ratcheting device preventing rotation of the outer terminator housing with respect to the inner connector body when the outer terminator housing is rotated in the first direction, the ratcheting device including at least one separate component from the outer terminator housing and the inner connector body. Furthermore, rotation of the outer terminator housing in a second direction does not cause rotation of the inner connector body in the second direction.

24 Claims, 6 Drawing Sheets

COAXIAL CABLE PORT LOCKING TERMINATOR AND METHOD OF USE THEREOF

FIELD OF THE INVENTION

The subject matter disclosed herein relates generally to the locking of coaxial cable interface ports. More particularly, this invention provides for a coaxial cable port locking terminator and a method of use thereof.

BACKGROUND OF THE INVENTION

Coaxial cable systems are often organized so that there is a central cable line connected to a tap assembly. The tap assembly has an outer housing and several ports for use in distributing signals to the individual subscribers through a drop line that connects the cable signal from the tap to the subscriber's home. The tap assemblies assist in providing multiple signals to multiple subscribers in the same geographic region. However, the tap assemblies may have more ports than subscribers, thereby leaving some ports unused and open. Termination of these unused and open ports is often desirable because an open port may affect the quality of the signal being transmitted to the other subscribers. Termination also helps to eliminate spurious electrical signals from entering an open port. Furthermore, open ports may allow for the unauthorized use of the cable signals by those who do not subscribe to the cable service (i.e. cable theft). To prevent these problems, locking terminators are often utilized. These terminators require a specialized tool not available to the general public in order to both apply and remove the terminator to the port.

Accordingly, an improved coaxial cable port locking terminator, and method of use thereof, would be well received in the art.

BRIEF DESCRIPTION OF THE INVENTION

According to one aspect of the invention, a coaxial cable interface port locking terminator comprises an outer terminator housing, an inner connector body housed within the outer terminator housing, and a ratcheting device in operable communication with the outer terminator housing and the inner connector body, the ratcheting device preventing rotation of the outer terminator housing with respect to the inner connector body when the outer terminator housing is rotated in the first direction, the ratcheting device including at least one separate component from the outer terminator housing and the inner connector body, wherein rotation of the outer terminator housing in a second direction does not cause rotation of the inner connector body in the second direction.

According to another aspect of the invention, a coaxial cable interface port locking terminator comprises an outer terminator housing, an inner connector body housed within the outer terminator housing, and a means for preventing rotation of the outer terminator housing with respect to the inner connector body when the outer terminator is rotated in a first direction, the means including at least one component separate from the outer terminator housing and the inner connector body, wherein rotation of the outer terminator housing in a second direction does not cause rotation of the inner connector body in the second direction.

According to yet another aspect of the invention, a coaxial cable interface port locking terminator comprises a port end, a drop line end, an outer terminator housing operable with a first ratcheting surface, the first ratcheting surface facing the port end, and an inner connector body operable with a second ratcheting surface, the second ratcheting surface facing the drop line end, the second ratcheting surface configured to engage the first ratcheting surface during rotation of the outer terminator body in a first direction, the second ratcheting surface configured to not significantly engage the first ratcheting surface during rotation of the outer terminator body in a second direction.

According to yet another aspect of the invention, a method of terminating a coaxial cable port comprises providing a locking terminator, the locking terminator including an outer terminator housing, an inner connector body housed within the outer terminator housing and a ratcheting device in operable communication with the outer terminator housing and the inner connector body, the ratcheting device preventing rotation of the outer terminator housing with respect to the inner connector body when the outer terminator housing is rotated in a first direction, the ratcheting device including at least one component separate from the outer terminator housing and the inner connector body, wherein rotation of the outer terminator housing in a second direction does not cause rotation of the inner connector body in the second direction. The method further comprises engaging the inner connector body with the coaxial cable port, and rotating the outer terminator housing in the first direction to tighten the inner connector body onto the coaxial cable port.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

A detailed description of the hereinafter described embodiments of the disclosed apparatus and method are presented herein by way of exemplification and not limitation with reference to the Figures.

Figure 1:
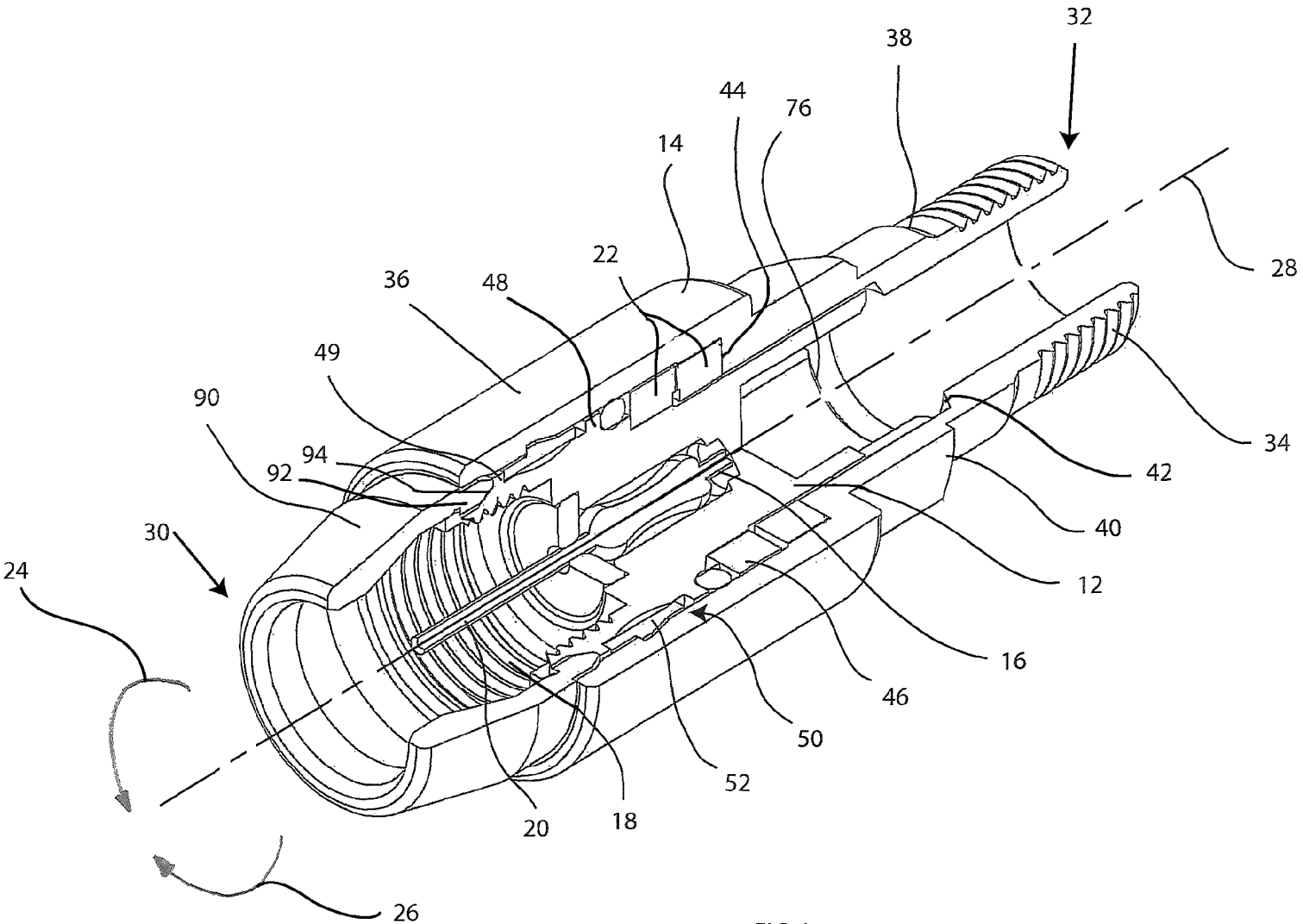
FIG. 1 depicts a perspective cutaway view of an embodiment of a coaxial port locking terminator according to one aspect of the present invention.
Figure 2:
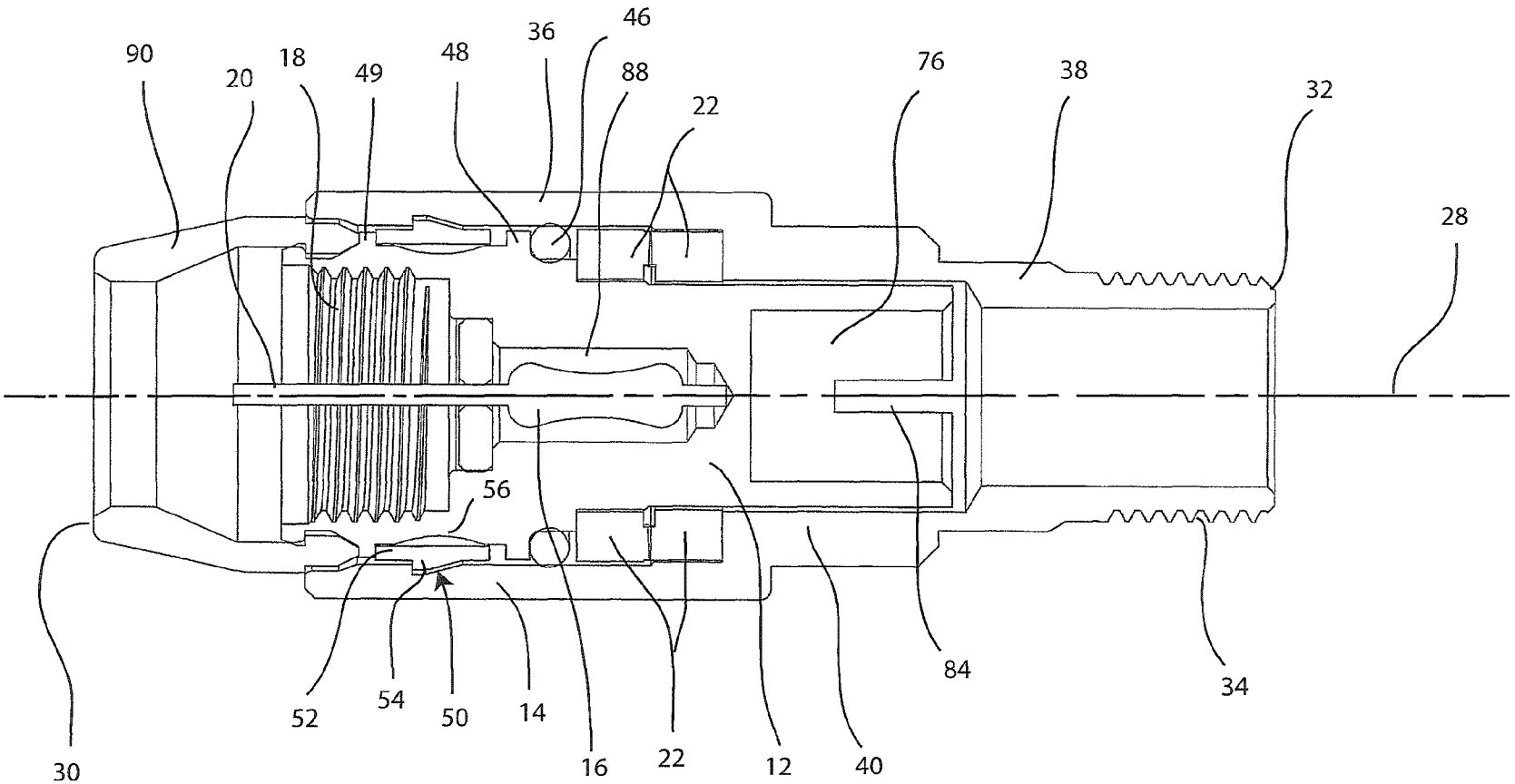
FIG. 2 depicts a side cross sectional view of an embodiment of a locking terminator.

Referring firstly to FIGS. 1-2, a coaxial port locking terminator 10 is shown according to one embodiment of the present invention. The coaxial port locking terminator 10 includes an inner connector body 12 substantially contained within an outer terminator housing 14. A resistor 16 is housed within the inner connector body 12. The inner connector body 12 includes internal threads 18 that engage with external threads of a typical coaxial cable interface port (not shown) during termination and locking of the port. During such termination, a resistor post 20 of the resistor 16 is inserted into a signal contact portion of the port (not shown) as the inner connector body 12 is threaded onto the port. This prevents electrical signals from being transmitted through the port. The coaxial port locking terminator further includes a ratcheting device 22 that prevents rotation of the outer terminator housing 14 with respect to the inner connector body 12 when the outer terminator housing 14 is rotated in a first direction 24. However, the ratcheting device 22 is configured such that rotation of the outer terminator housing 14 in an opposite second direction 26 does not cause rotation of the inner connector body 12 in the second direction 26. Accordingly, the ratcheting device 22 allows the outer terminator housing 14 to be rotated in the first direction 24 to tighten the coaxial port locking terminator 10 to the port. Once attached to the port, the ratcheting device 22 prevents a person from trying to remove the coaxial port by rotating the outer terminator housing 14 in the second direction 26. Instead, removal of the coaxial port locking terminator 10 from the port requires the use of a specialized tool 27 (shown in FIG. 6). Thus, the coaxial port locking terminator 10 is easy to install while being resistant to attempts at removal by an unauthorized person who is not in possession of the specialized tool 27.

The principal components of the assembled coaxial port locking terminator 10 are all substantially rotationally symmetric about a longitudinal axis 28. Particularly, the outer terminator housing 14, the inner connector body 12, the resistor 16 and the ratcheting device 22 may be substantially rotationally symmetric about the longitudinal axis 28. It should be understood that the coaxial port locking terminator 10 is not completely rotationally symmetric about the longitudinal axis 28, and the exceptions to complete rotational symmetry, such as the dimensions of the threads, will be readily apparent to those skilled in the art. Another example of an exception to complete rotational symmetry may be the ramped protrusions.

Furthermore, the coaxial port locking terminator 10 will hereinafter be described with respect to a port end 30 and a drop line end 32. Each of the ends 30, 32 are located at opposite sides of the coaxial port locking terminator 10 along the longitudinal axis 28. The coaxial port locking terminator 10 attaches to the port from the port end 30 via the internal threads 18 of the inner connector body 12 as described hereinabove. The outer terminator housing 14 includes external threads 34 located proximate to the drop line end 32 for connecting the locking terminator device 10 to a drop line (not shown). For instance, if a locking terminator device is used only to suspend service to a customer for a limited time, the drop line can be attached via the threads 34 to the outer terminator housing 14. Thus, when the coaxial port locking terminator 10 is removed in order to reinstate a previously suspended cable service, the drop cable line will be readily available for connection.

The outer terminator housing 14 is shown to be rotationally symmetric about a longitudinal axis 28. The outer terminator housing 14 may include three distinct sections with different internal and external diameters. For example, a housing section 36 may be located proximate to the port end 30, a drop line section 38 may be located proximate to the drop line end 32, and an intermediate section 40 may be located between the first and second sections 36, 38. Each of the sections 36, 38, 40 of the outer terminator housing 14 may have smaller internal and external diameters than the previous of the sections 36, 38 along the longitudinal axis 28 from the port end 30 to the drop line end 32.

The external surface of the outer terminator housing 14 may have a variety of properties specific to a particular section 36, 38, 40. For example, the housing section 36 may have a fully or partially knurled external surface (not shown) in order to aid in the grip of a user when rotating the outer terminator housing 14 by hand. The external surface of the intermediate section 40 may be a hexagonal nut, as shown in the Figures. This further aids in the tightening processes of the coaxial port locking terminator 10. The hexagonal nut may have any appropriate dimension so that a wrench, such as a socket wrench, may be used to tighten the coaxial port locking terminator 10 on a port. It should be understood of course that the hexagonal nut is another example of a portion of the coaxial port locking terminator 10 that is not completely rotationally symmetrical. Furthermore, the drop line section 38 may include the externally threads 34 for attachment to an internally threaded cable connector or a drop line as described hereinabove. In the case that no drop line exists to correspond with an unused port (if an output port to be terminated has never been used by any subscriber), an internally threaded cap (not shown) may be screwed onto the external threads 34 in order to help seal the port and the coaxial port locking terminator 10 from environmental elements. The drop line section 38 may also include a smooth external wall between the threads 34 and the intermediate section 40.

The interior surface of the outer terminator housing 14 is dimensioned to receive the external surface of the inner connector body 12. Thus, the internal diameter of the outer terminator housing may correspond in dimensions with much of the external diameter of the inner connector body 14 along the longitudinal axis 28. However, the interior surface of the outer terminator housing 14 and the external surface of the inner connector body 12 may be particularly dimensioned with spacing to make room for housing certain components of the coaxial port locking terminator 10. Furthermore, the internal surface of the outer terminator housing 14 at the drop line end 32 may be dimensioned to receive the specialized tool 27, (see FIG. 6). Thus, the internal surface of the drop line section 38 may have a slightly larger diameter than the diameter of the specialized tool 27 such that the specialized tool 27 may be inserted therein.

The interior surface of the outer terminator housing 14 may include two lips 42, 44 that reduce the internal diameter of the housing 14 along the longitudinal axis 28 from the port end 30 to the drop line end 32 and divide the sections 36, 38, 40. A first lip 42 may be dimensioned to retain the drop line side 32 of the inner connector body 12 and prevent the inner connector body 12 from moving along the longitudinal axis 28 in the direction of the drop line side 32. The first lip 42 may be angled to accept a correspondingly angled end of the inner connector body 12, as shown in the Figures. Furthermore, a second lip 44 is dimensioned to define a space between the outer terminator housing 14 and the inner connector body 12 in order to retain the ratcheting device 22 and a biasing member 46. Particularly, the ratcheting device 22 and the biasing member 46 are retained between the second lip 44 and a first rim 48 that circumferentially surrounds the inner connector body 12. The ratcheting device 22 and the biasing member 46 will be described herein below.

The interior side of the outer terminator housing 14 also includes a recess 50 for housing a snap bearing 52 between the outer terminator housing 14 and the inner connector body 12. The snap bearing 52 may be a ridged or barbed ring disposed about the inner connector housing. Shown in the Figures, the snap bearing 52 includes a ridge 54 that is dimensioned to fit snugly within the recess 46. The snap bearing 52 allows the outer terminator housing 14 to rotate relative to the inner connector body 12. In combination, the recess 50 and the snap bearing 52 facilitate the attachment of the inner connector body 12 within the outer terminator housing 14 by preventing movement of the inner connector body 12 along the longitudinal axis 28 in the direction of the port end 30. In assembly, the inner connector body 12 may be inserted into the outer terminator housing 14 from the port side 28. The snap bearing may temporarily deform within a smooth recess 56 within the outer surface of the inner connector body 12. Once the ridge 54 is inserted past the recess 50, the inner connector body 12 is permanently snap-retained within the outer terminator housing 14. The first rim 48 and a second rim 49 (that is also located circumferentially about the inner connector body 12) retain the snap bearing 52 between the inner connector body 12 and the outer terminator housing 14.

Figure 3:
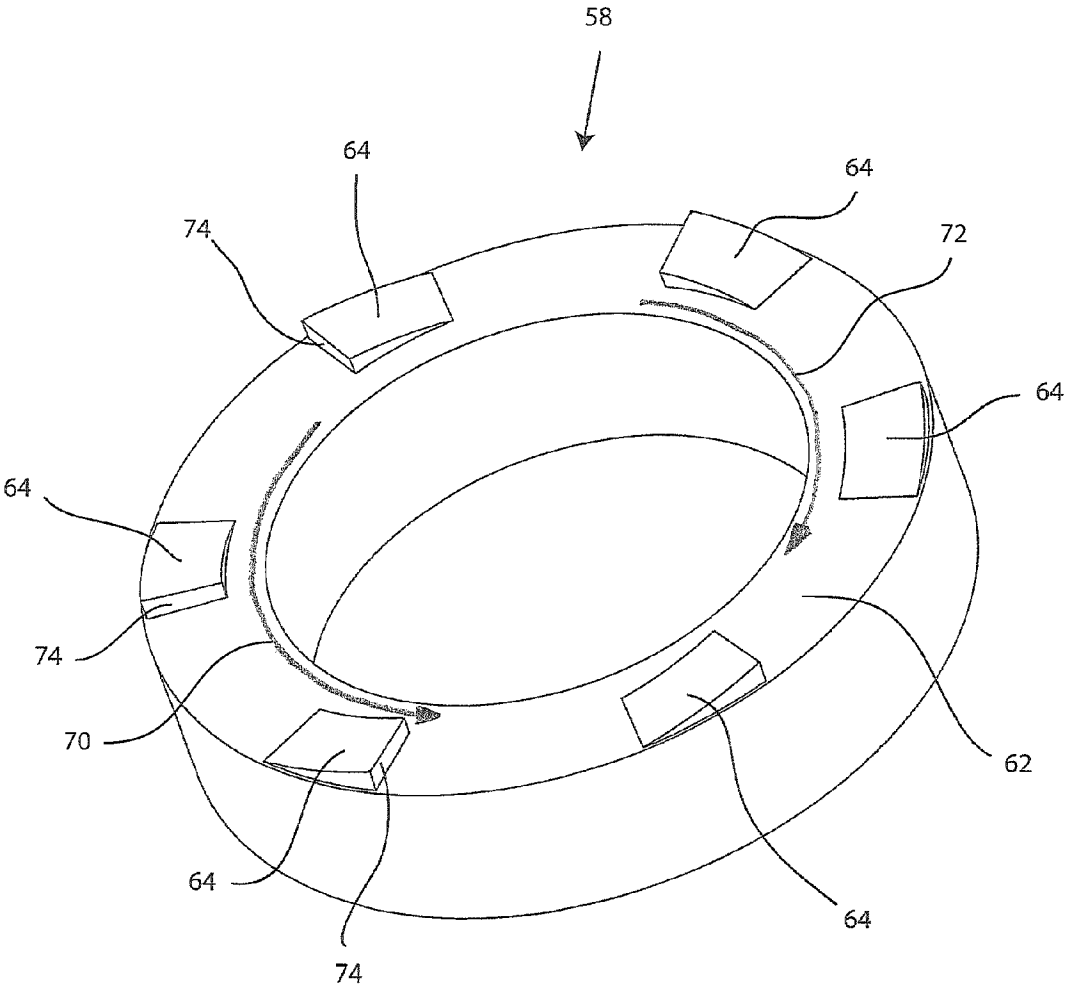
FIG. 3 depicts a perspective view of an embodiment of a ratcheting element independent of the rest of the locking terminator.
Figure 4:
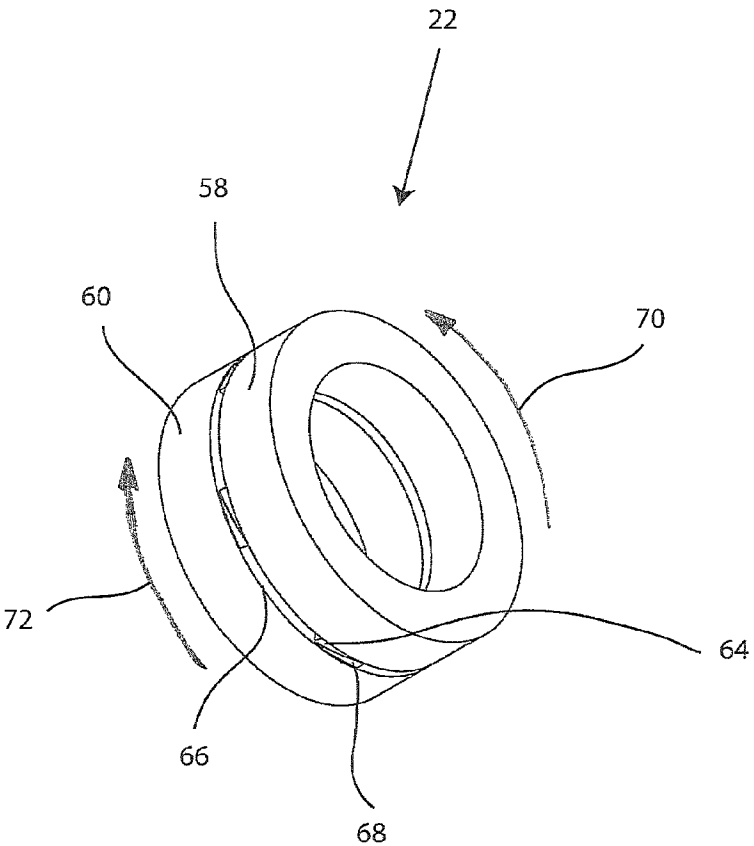
FIG. 4 depicts a perspective view of embodiments of two corresponding ratcheting elements removed from the rest of an associated locking terminator.
Figure 5:
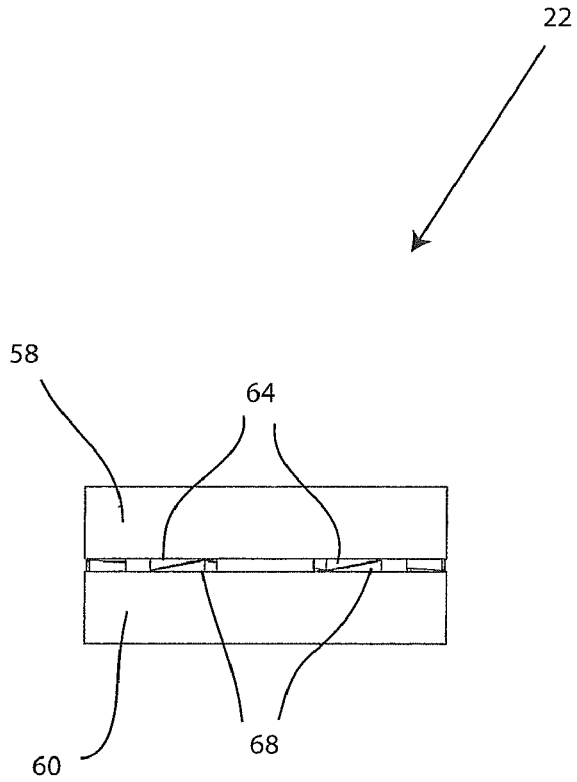
FIG. 5 depicts a side view of embodiments of two corresponding ratcheting elements removed from the rest of an associated locking terminator.

Referring now to FIGS. 1-2 in conjunction with FIGS. 3-5, the ratcheting device 22 is shown in greater detail. The ratcheting device 22 is in operable communication with the outer terminator housing 14 and the inner connector body 12. In the embodiment shown, the ratcheting device 22 includes two ratcheting rings 58, 60. A first ratcheting ring 58 is attached to the outer terminator housing 14 while a second ratcheting ring 60 is attached to the inner connector body 12. In other words, the first ratcheting ring 58 rotates with the outer terminator housing 14, while the second ratcheting ring 60 rotates with the inner connector body 12. While the first and second ratcheting rings 58, 60 may be attached with a glue, an epoxy, by soldering, by welding, or by heat deformation, any attachment means may be appropriate. In some embodiments, the ratcheting rings 58, 60 may be drilled into the inner connector body 12 and outer terminator housing 14 respectively. Moreover, the ratcheting rings 58, 60 may be respectively press fit into a corresponding housing compartment 12, 14. In other embodiments, rings 58, 60 may not be utilized at all, but instead may comprise features integrally included onto the internal surface of the outer terminator housing and on the external surface of the inner connector body. In one embodiment, it is contemplated that at least one of the ratcheting rings 58, 60 is a separate part from either the inner connector body 12 or the outer terminator housing 14. In this embodiment the ratcheting ring 58, 60 that is separate may be interference fit with the housing 14 or the body 12. The interference fit may be dimensioned such that the ratcheting ring 58, 60 breaks free from the housing 14 or the body 12 when a particular or predetermined amount of tightening torque is applied. This may prevent a user from applying too much torque during tightening which in turn may prevent stripping the threads of the coaxial port locking terminator 10 and the port 22. It should be understood that the invention is not limited to these embodiments, and equivalent attachment means will be understood by those skilled in the art.

The first ratcheting ring 58 includes a first ratcheting surface 62 having a first plurality of ramped protrusions 64 located thereon. The second ratcheting ring 60 also includes a corresponding second ratcheting surface 66 having a second plurality of ramped protrusions 68. The ramped protrusions 64, 68 are shown equispaced about the circumference of the corresponding surfaces 62, 66. The first and second ratcheting rings 58, 60 are operably assembled and attached such that the surfaces 62, 66 are facing and adjacent. However, the first plurality of ramped protrusions 64 have slopes extending in a first radial direction 70 and the second plurality of ramped protrusions 68 have slopes extending in a second radial direction 72 that is opposite the first radial direction 70 when the coaxial port locking terminator 10 is assembled. Furthermore, the ramped protrusions 64, 68 may each include a normal face 74 extending normal from the surface 62, 66 to the maximum height of the ramped protrusion 64, 68. The faces 74 may be normal to the surfaces 62, 66, however it should be understood that the faces 74 may extend from the surfaces 62, 66 at any appropriate angle, such as an oblique angle, such that the faces 74 may engage with corresponding ratcheting elements. It should be understood that the ramped protrusions 64, 68 may be another element of the coaxial port locking terminator 10 that is not completely rotationally symmetrical.

The ramped protrusions 64, 68 prevent the first ratcheting ring 58 and the attached outer terminator housing 14 from rotating in the first radial direction 70 with respect to the second ratcheting ring 60 and the attached inner connector body 12. This is because the normal faces 74 align and operably engage in order to prevent rotation in the first radial direction 70. The first radial direction 70 is the direction that the inner connector body 12 must be rotated in order to tighten the coaxial port locking terminator 10 onto the port. Thus, rotation in the first radial direction 70 of the outer terminator housing 14, and consequently the first ratcheting ring 58, forces the second ratcheting ring 60, and consequently the inner connector body 12, to rotate in the first radial direction 70 and thereby tightening the coaxial port locking terminator 10 onto a port without needing a tool 27 (shown in FIG. 6).

On the other hand, rotation of the first ratcheting ring 58 and the outer terminator housing 14 in the second radial direction 72 does not cause engagement of the second ratcheting ring 60. Instead, the ramped protrusions 64, 68 slide past each other without significantly catching or engaging. It should be understood that rotation of the inner connector body 12 in the second radial direction 72 loosens the coaxial port locking terminator 10 off of the port. However, because the ramped protrusions 64, 68 slide past each other without significant operable engagement, the rotation of the outer terminator housing 14 in the second radial direction 72 may not cause rotation of the inner connector body 12 in the second radial direction 72 and therefore may not loosen the coaxial port locking terminator 10 off the port. Moreover, with respect to various embodiments, rotation of the outer terminator housing 14 in the second radial direction 72 cannot cause rotation of the inner connector body 12 in the second radial direction 72. Instead the tool 27 may be required to rotate the inner connector body 12 in the second radial direction 72.

Furthermore, the biasing member 46 may be configured to keep the ratcheting device 22 under tension. In other words, the biasing member 46 may put pressure on the second ratcheting ring 60 axially in the direction of the first ratcheting ring 58. This pressure may help to hold the ratcheting surfaces 62, 66 together to insure proper engagement. In order to achieve this, the biasing member 46 may be made of a deformable resilient material. The deformable resilient material may also allow the biasing member 46 to be resiliently deformed when positioned between the outer terminator housing 14 and the inner connector body 12, thereby sealing the gap between the two. The biasing member 46 may thereby serve the purpose of facilitating a tighter connection between the outer terminator housing 14 and the inner connector body 12. The biasing member 46 may be an O-ring made of silicone rubber, for example. Alternately, the biasing member 46 may also be configured to pull the ratcheting surfaces 62, 66 apart. In this embodiment, the coaxial port locking terminator 10 may only be tightened by pushing hard with axial force in order to cause the surfaces 62, 66 to engage.

While the ratcheting device 22 has been described with respect to one embodiment, other means are contemplated for preventing the rotation of the outer terminator housing 14 with respect to the inner connector body 12 when the outer terminator housing 12 is rotated in the first radial direction 70.

For example, only one of the surfaces 62, 66 may contain ramped protrusions 64, 68 while the other of the surfaces 62, 66 may contain similarly dimensioned recesses. It should be understood that any cooperating pair of detents and protrusions 64, 68 may suffice as long as they are shaped to cause a greater physical interlock in a first direction than a second direction. Additionally, means may include a gearwheel with a pawl, a freewheel, or a sprag. It should be understood that this list is not exhaustive and that other equivalent means will be apparent to those skilled in the art.

Figure 6:
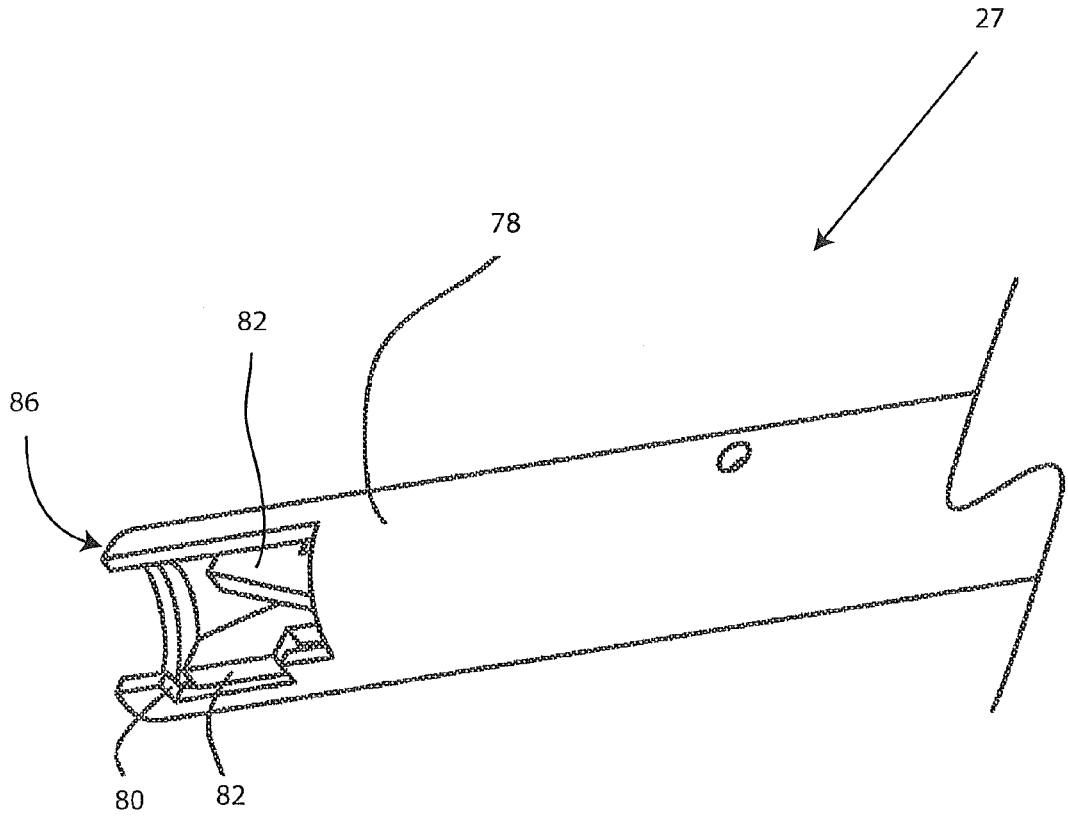
FIG. 6 depicts a perspective view of an embodiment of a specialized tool used to loosen an embodiment of a locking terminator, in accordance with the present invention.

Referring back solely to FIGS. 1 and 2, in combination with FIG. 6, the inner connector body 12 has a cavity 76 located at the drop line end 32. The cavity 76 extends the opening formed by the internal surface of the drop line section 38 for receipt of the tool 27. The tool 27 is shown in FIG. 6 having an outer cylindrical housing 78 which has openings 80 on opposite sides of the housing 78 for exposing tool feet 82. The outer cylindrical housing 78 has a smaller outer diameter than the inner diameter of the drop line section 38 and the cavity 76. The cavity 76 includes slots 84 into which tool feet 82 of the tool 27 fit for engagement when unlocking the coaxial port locking terminator 10 from the port. The slots 84 are on opposite sides because the tool feet 82 spread out as pressure is applied to an end surface 86 of the tool 27. Thus, the slots 84 are another element that may not be not be rotationally symmetric about the longitudinal axis 28. Alternately, the tool feet 82 may be spring loaded in order to constantly bias the tool feet 82 in the spread out position. In this embodiment, the tool feet 82 may be compressed within the circumference of the tool for insertion into the inner surface of the drop line section 38 and the cavity 76. The tool feet 82 may then spread out automatically once they engage the slots 78, 80. Whatever, the embodiment, the tool feet 82 may be used to apply torque and directly rotate the inner connector body 12 in the second radial direction 72. It should be understood that the invention is not limited to an embodiment having the slots 84 that accept the tool feet 82 to apply torque in the second radial direction 72. While this is an exemplary embodiment, other means for directly rotating the inner connector body 12 will be apparent to those skilled in the art.

Referring still to FIGS. 1-2, the coaxial port locking terminator 10 also includes the resistor 16 housed within inner connector body 12. The body of the resistor 16 is housed within a chamber 88 of the inner connector body 12 and the resistor post 20 extends from the chamber 88 and for insertion into the signal output hole of the output port that is to be terminated when a connection is made. In one embodiment, the resistor 16 is a carbon-film 75-ohm, ¼-watt resistor that may match a 75-ohm impedance of a common coaxial cable. The resistor chamber 88 may be structurally separated by both the cavity 76 and the internal threads 18 of the inner connector body 12. Furthermore, the inner connector body 12 may be constructed from a material that is electrically conductive so as to create an electrical connection with the resistor 16 when the coaxial port locking terminator 10 is assembled. It should be understood that the resistor chamber 88 may or may not be structurally integral to the inner connector body 12. For example, the resistor chamber 88 may be within a separate resistor case (not shown) that may be housed within the inner connector body 12.

The coaxial port locking terminator 10 may also include a connector cap 90 attached between the inner connector body 12 and the outer terminator housing 14 at the port end 30. The connector cap 90 includes a flange 92 to fit into a recess 94 located between the inner connector body 12 and the outer terminator housing 14. The connector cap 90 may function to protect the connection from weather and the elements, and further prevent tampering by an unauthorized user.

The components of the coaxial port locking terminator 10 may be constructed of any material that is sufficiently strong that it may be snap fitted as described above with respect to the assembly of the coaxial port locking terminator 10. Also, the components may be sufficiently durable and resistant to tampering, which durability may include crushing, pulling, bending, striking or other physical or electromagnetic activity likely to occur from an unauthorized user or from the weather and elements. The outer terminator housing 14 may be particularly resistant to tampering because it is the external part of the device that houses the other components within. One example of an appropriate material to be used for the components is a metal, such as brass. In another embodiment of the invention, a durable plastic, such as Ultem™, may be used for some or all of the components. Other examples may include stainless steel, rubber, ceramic, glass-filled polycarbonate, or Delrin Plastic™. Many other materials may be apparent to those skilled in the art.

Furthermore, another embodiment of the present invention contemplated is a method of terminating a coaxial cable port comprising providing a locking terminator, such as the coaxial port locking terminator 10. The locking terminator may include an outer terminator housing, such as the outer terminator housing 14, and an inner connector body housed with in the outer terminator housing, such as the inner connector body 12. The locking terminator may also include a ratcheting device, such as the ratcheting device 22 in operable communication with the outer terminator housing 14 and the inner connector body 12, the ratcheting device preventing rotation of the outer terminator housing with respect to the inner connector body when the outer terminator housing is rotated in the first direction. It should be understood that the term "operable communication" may mean that the ratcheting device 22 is in contact with the outer terminator housing 14. However, other communication means, such as magnetic communication, are contemplated. The locking terminator may also include a resistor, such as the resistor 16, housed within the inner connector body. The locking terminator is configured such that rotation of the outer terminator housing in a second direction does not cause rotation of the inner connector body of the second direction. Furthermore, the method comprises engaging the inner connector body with the coaxial cable port and rotating the outer terminator housing in the first direction to tighten the inner connector body onto the coaxial cable port. The method further includes inserting a specialized tool, such as the tool 27, into the locking terminator to engage the inner connector body and rotating the tool in the second direction to cause rotation of the inner connector body in the second direction, thereby loosening the locking terminator from the port.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A coaxial cable interface port locking terminator comprising:

an outer terminator housing;

an inner connector body housed within the outer terminator housing, wherein the inner connector body includes internal threads configured to engage external threads of a coaxial cable interface port; and a ratcheting device including a first ratcheting ring attached to the outer terminator housing having a first ratcheting surface and a second ratcheting ring attached to the inner connector body having a second ratcheting surface, wherein the second ratcheting ring rotates with the inner connector body, the ratcheting device preventing rotation of the outer terminator housing with respect to the inner connector body when the outer terminator housing is rotated in the first direction, the ratcheting device including at least one separate component from the outer terminator housing and the inner connector body;

wherein rotation of the outer terminator housing in a second direction does not cause rotation of the inner connector body in the second direction wherein the first ratcheting surface is axially opposed to the second ratcheting surface.

2. The locking terminator of claim 1, further including a biasing member, the biasing member configured to keep the ratcheting device under tension.

3. The locking terminator of claim 1, wherein the rotation of the outer terminator housing in the second direction cannot cause rotation of the inner connector body in the second direction.

4. The locking terminator of claim 1, wherein one end of the outer terminator is externally threaded.

5. The locking terminator of claim 1, wherein the inner connector body includes at least one slot for receiving a portion of a tool.

6. The locking terminator of claim 1, further comprising a resistor housed within the inner connector body.

7. The locking terminator of claim 1, wherein the first ratcheting surface is facing and adjacent to the second ratcheting surface.

8. The locking terminator of claim 7, wherein the inner connector body, the outer terminator housing, the resistor, the first ratcheting ring and the second ratcheting ring are substantially rotationally symmetric about a longitudinal axis.

9. The locking terminator of claim 7, wherein the first ratcheting surface includes a first ramped protrusion located thereon.

10. The locking terminator of claim 9, wherein the second ratcheting surface includes a second ramped protrusion located thereon, wherein the first and second ramped protrusions have slopes extending in opposite radial directions.

11. The locking terminator of claim 10, wherein the first surface includes a plurality of the first ramped protrusions, and wherein the second surface includes a plurality of the second ramped protrusions, wherein the ramped protrusions are located in an equispaced arrangement.

12. A coaxial cable interface port locking terminator comprising:

an outer terminator housing;

an inner connector body housed within the outer terminator housing, wherein the inner connector body includes internal threads configured to engage external threads of a coaxial cable interface port; and a means for preventing rotation of the outer terminator housing with respect to the inner connector body when the outer terminator is rotated in a first direction, the means including at least a first ratcheting ring and a second ratcheting ring, wherein at least one of the first ratcheting ring and second ratcheting ring is separate from the outer terminator housing and the inner connector body to break free at a predetermined amount of applied torque;

wherein rotation of the outer terminator housing in a second direction does not cause rotation of the inner connector body in the second direction wherein a first ratcheting surface of the first ratcheting ring is axially opposed to a second ratcheting surface of the second ratcheting ring.

13. A coaxial cable interface port locking terminator comprising:

a port end;

a drop line end;

an outer terminator housing interference fit with a first ratcheting ring having a first ratcheting surface, the first ratcheting surface facing the port end; and an inner connector body including internal threads configured to engage external threads of a coaxial cable interface port, the inner connector body being operable with a second ratcheting ring having a second ratcheting surface, the second ratcheting surface facing the drop line end, the second ratcheting surface configured to engage the first ratcheting surface during rotation of the outer terminator body in a first direction, the second ratcheting surface configured to not significantly engage the first ratcheting surface during rotation of the outer terminator body in a second direction;

wherein the interference fit between the first ratcheting surface and the outer terminator housing is dimensioned to allow the first ratcheting ring to break free from the outer terminator housing when a predetermined amount of tightening torque is applied.

14. The locking terminator of claim 13, wherein the inner connector body, the outer terminator housing, and the resistor are substantially rotationally symmetric about a longitudinal axis.

15. The locking terminator of claim 13, wherein the first ratcheting surface includes a first ramped protrusion located thereon.

16. The locking terminator of claim 15, wherein the second surface includes a second ramped protrusion located thereon, wherein the first and second ramped protrusions have slopes extending in opposite radial directions when the first surface is facing the second surface.

17. The locking terminator of claim 16, wherein the first surface includes a plurality of the first ramped protrusions, and wherein the second surface includes a plurality of the second ramped protrusions.

18. The locking terminator of claim 13, further including a biasing member, the biasing member configured to keep the first and second ratcheting surfaces under tension.

19. The locking terminator of claim 13, wherein the rotation of the outer terminator housing in the second direction cannot cause rotation of the inner connector body in the second direction.

20. The locking terminator of claim 13, further comprising a resistor housed within the inner connector body.

21. A method of terminating a coaxial cable port comprising:

providing a locking terminator, the locking terminator including:

an outer terminator housing;

an inner connector body housed within the outer terminator housing, wherein the inner connector body includes internal threads configured to engage external threads of a coaxial cable interface port; and a ratcheting device including a first ratcheting ring attached to the outer terminator housing having a first ratcheting surface and a second ratcheting ring attached to the inner connector body having a second ratcheting surface, the ratcheting device preventing rotation of the outer terminator housing with respect to the inner connector body when the outer terminator housing is rotated in a first direction, the ratcheting device including at least one component separate from the outer terminator housing and the inner connector body;

wherein rotation of the outer terminator housing in a second direction does not cause rotation of the inner connector body in the second direction;

wherein at least one of the first ratcheting ring and the second ratcheting ring are configured to break free from at least one of the outer terminator housing and the inner connector body when a predetermined amount of torque is applied;

wherein the first ratcheting surface is axially opposed to the second ratcheting surface, engaging the inner connector body with the coaxial cable port; and rotating the outer terminator housing in the first direction to tighten the inner connector body onto the coaxial cable port.

22. The method of terminating a coaxial cable port of claim 21, further comprising inserting a tool into the locking terminator to engage the inner connector body and rotating the tool in the second direction to cause rotation of the inner connector body in the second direction.

23. The method of terminating a coaxial cable port of claim 21 wherein the locking terminator further includes a resistor housed within the inner connector body.

24. A coaxial cable interface port locking terminator comprising:

a port end;

a drop line end;

an outer terminator housing operable with a first ratcheting ring having a first ratcheting surface, the first ratcheting surface facing the port end; and an inner connector body including internal threads configured to engage external threads of a coaxial cable interface port, the inner connector body being interference fit with a second ratcheting ring having a second ratcheting surface, the second ratcheting surface facing the drop line end, the second ratcheting surface configured to engage the first ratcheting surface during rotation of the outer terminator body in a first direction, the second ratcheting surface configured to not significantly engage the first ratcheting surface during rotation of the outer terminator body in a second direction;

wherein the interference fit between the second ratcheting surface and the inner connector body is dimensioned to allow the second ratcheting ring to break free from the inner connector body when a predetermined amount of tightening torque is applied.

* * * * *

UNITED STATES PATENT AND TRADEMARK OFFICE

CERTIFICATE OF CORRECTION

PATENT NO. : 8,070,504 B2
APPLICATION NO. : 12/486009
DATED : December 6, 2011
INVENTOR(S) : Amidon et al.

It is certified that error appears in the above-identified patent and that said Letters Patent is hereby corrected as shown below:

In the Specification, column 5, line 47, after the word "port" delete the number "22"

Signed and Sealed this
Sixth Day of March, 2012

David J. Kappos

David J. Kappos
*Director of the United States Patent and Trademark Office*